US007347904B2

(12) United States Patent
Sasai et al.

(10) Patent No.: US 7,347,904 B2
(45) Date of Patent: Mar. 25, 2008

(54) LOW CARBON STEEL SHEET AND LOW CARBON STEEL SLAB AND PROCESS FOR PRODUCING SAME

(75) Inventors: Katsuhiro Sasai, Futtsu (JP); Wataru Ohashi, Futtsu (JP); Tooru Matsumiya, Futtsu (JP); Yoshiaki Kimura, Kimitsu (JP); Junji Nakashima, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 35 days.

(21) Appl. No.: 10/481,800

(22) PCT Filed: Jun. 28, 2002

(86) PCT No.: PCT/JP02/06598

§ 371 (c)(1),
(2), (4) Date: Dec. 22, 2003

(87) PCT Pub. No.: WO03/002771

PCT Pub. Date: Jan. 9, 2003

(65) Prior Publication Data

US 2004/0168749 A1 Sep. 2, 2004

(30) Foreign Application Priority Data

| | | |
|---|---|---|
| Jun. 28, 2001 | (JP) | 2001-196724 |
| Jan. 23, 2002 | (JP) | 2002-014451 |
| Mar. 18, 2002 | (JP) | 2002-074561 |
| May 28, 2002 | (JP) | 2002-153302 |

(51) Int. Cl.
*C22C 38/00* (2006.01)

(52) U.S. Cl. ..... 148/331; 420/83

(58) Field of Classification Search ..... 148/320
See application file for complete search history.

(56) References Cited

U.S. PATENT DOCUMENTS

| | | | | |
|---|---|---|---|---|
| 3,960,616 A | | 6/1976 | Evans et al. | |
| 4,289,533 A | * | 9/1981 | Gunji et al. | 420/528 |
| 6,117,389 A | * | 9/2000 | Nabeshima et al. | 420/83 |
| 6,344,093 B1 | * | 2/2002 | Ohmori et al. | 148/320 |
| 6,406,565 B1 | * | 6/2002 | Hashimura et al. | 148/333 |
| 7,226,493 B2 | * | 6/2007 | Grong et al. | 75/255 |

FOREIGN PATENT DOCUMENTS

| | | | | |
|---|---|---|---|---|
| CN | 1218839 A | | 6/1999 | |
| EP | 0 829 546 A1 | | 3/1998 | |
| GB | 1 453 717 A | | 10/1976 | |
| JP | 362244561 | * | 10/1987 | 164/56.1 |
| JP | A-63-149057 | | 6/1988 | |
| JP | 63-176417 | | 7/1988 | |
| JP | 1-172508 A | | 7/1989 | |
| JP | 3-104844 A | | 5/1991 | |
| JP | 3-287711 A | | 12/1991 | |
| JP | 4-309444 A | | 11/1992 | |
| JP | 4-314844 A | | 11/1992 | |
| JP | A-5-104219 | | 4/1993 | |
| JP | A-5-302112 | | 11/1993 | |
| JP | 8-218112 | | 8/1996 | |
| JP | 10-258343 A | | 9/1998 | |
| JP | 11-100611 A | | 4/1999 | |
| JP | 11 323426 A | | 11/1999 | |
| JP | 11-343516 A | | 12/1999 | |
| JP | 2000-96182 A | | 4/2000 | |
| JP | 2001-49326 A | | 2/2001 | |
| WO | WO 00/33992 A | | 6/2000 | |

OTHER PUBLICATIONS

Acta Metallurgica Sinica, Jun 1978, vol. 14, No. 2, pp. 196-197.

* cited by examiner

*Primary Examiner*—George Wyszomierski
(74) *Attorney, Agent, or Firm*—Kenyon & Kenyon LLP

(57) ABSTRACT

The present invention provides a low carbon steel sheet and a low carbon steel slab on which formation of surface defects can be surely prevented by preventing aggregation of inclusions in the molten steel and finely dispersing inclusions in the steel sheet or slab, and a process for producing the steel sheet and slab. The present invention provides a process comprising the steps of decarburizing a molten steel so as to produce a carbon concentration of up to 0.01% by mass, pre-deoxidizing the molten steel by adding Al thereto so as to produce a dissolved oxygen concentration from 0.01 to 0.04% by mass, adding thereto Ti and at least La and/or Ce, and casting the molten steel, and a steel sheet and a steel slab obtained by the process.

16 Claims, No Drawings

LOW CARBON STEEL SHEET AND LOW CARBON STEEL SLAB AND PROCESS FOR PRODUCING SAME

TECHNICAL FIELD

The present invention relates to a low carbon steel sheet and a low carbon steel slab which are excellent in workability and formability and on which surface defects are hardly formed, and a process for producing the same.

In addition, the term "low carbon" in the present invention particularly defines no upper limit of a carbon concentration, but signifies that the carbon concentration is relatively low in comparison with other steel types. In addition, because a steel sheet is used for applications in which the steel sheet is particularly severely worked, for example, external plates of automobiles, the steel sheet must be made to have workability. The carbon concentration is therefore up to 0.05% by mass, preferably up to 0.01% by mass. The lower limit of a carbon concentration is not particularly defined.

BACKGROUND ART

A molten steel having been refined with a converter or a vacuum treatment vessel contains a large amount of dissolved oxygen. The excessive oxygen is generally deoxidized with Al that is a strong deoxidizing element having strong affinity for oxygen. However, Al forms $Al_2O_3$ inclusions through deoxidation, and the inclusions aggregate to form coarse alumina clusters each having a size of at least several hundreds of micrometers. The alumina clusters cause generation of surface defects during the production of a steel sheet, and greatly deteriorate the quality of the steel sheet. In particular, for a low carbon molten steel as a material for a steel sheet that has a low carbon concentration and, after refining, a high dissolved oxygen concentration, the amount of alumina clusters is very large. The generation ratio of surface defects of a steel sheet produced therefrom is extremely high, and measures for decreasing the $Al_2O_3$ inclusions remain as an important problem to be solved.

In order to decrease the $Al_2O_3$ inclusions, the following methods have heretofore been proposed and carried out: a method described in Japanese Unexamined Patent Publication (Kokai) No. 5-104219 comprising adding flux for adsorbing inclusions on a molten steel surface to remove $Al_2O_3$ inclusions; and a method described in Japanese Unexamined Patent Publication (Kokai) No. 63-149057 comprising adding CaO flux to a molten steel with the flow of pouring the molten steel utilized whereby $Al_2O_3$ inclusions are adsorbed and removed. On the other hand, Japanese Unexamined Patent Publication (Kokai) No. 5-302112 discloses, not as a method of removing $Al_2O_3$ inclusions but as a method of not forming $Al_2O_3$, a method of preparing a molten steel for a steel sheet, which comprises deoxidizing a molten steel with Mg and in which the molten steel is substantially not deoxidized with Al.

However, it is very difficult to remove $Al_2O_3$ inclusions formed in a low carbon molten steel in a large amount and to such a degree that surface defects are not formed, by the methods of removing $Al_2O_3$ inclusions explained above. Moreover, when a molten steel is deoxidized by Mg deoxidation that forms no $Al_2O_3$ inclusions, the Mg vapor pressure is high, and the yield of Mg in the molten steel is very low. Accordingly, a large amount of Mg is required to deoxidize, with Mg alone, a molten steel having a high dissolved oxygen concentration such as a low carbon steel.

Therefore, it cannot be said that the process is practical when the production cost is taken into consideration.

In view of these problems, an object of the present invention is to provide a low carbon steel sheet and a low carbon steel slab on which formation of surface defects can be surely prevented by preventing aggregation of inclusions in the molten steel and finely dispersing inclusions in the steel sheet or slab, and a process for producing the steel sheet and slab.

DISCLOSURE OF THE INVENTION

The present invention has been achieved to solve the above problems, and the aspects of the invention will be explained below.

(1) A low carbon steel sheet characterized in that fine oxide inclusions having a diameter from 0.5 to 30 μm are dispersed therein with the number being from not less than 1,000 to less than 100,000 pieces/$cm^2$.

(2) A low carbon steel sheet characterized in that not less than 60% by mass of oxide inclusions present therein contain at least La and/or Ce.

(3) A low carbon steel sheet characterized in that not less than 60% by mass of oxide inclusions present therein are spherical or spindle-like oxide inclusions containing at least La and/or Ce.

(4) A low carbon steel sheet characterized in that not less than 60% by mass of oxide inclusions present therein are oxide inclusions containing not less than 20% by mass of at least La and/or Ce in the form of $La_2O_3$ and/or $Ce_2O_3$.

(5) A low carbon steel sheet characterized in that not less than 60% by mass of oxide inclusions present therein are spherical or spindle-like oxide inclusions containing not less than 20% by mass of at least La and/or Ce in the form of $La_2O_3$ and/or $Ce_2O_3$.

(6) A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions contain at least La and/or Ce.

(7) A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions are spherical or spindle-like oxide inclusions containing at least La and/or Ce.

(8) A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions are oxide inclusions containing not less than 20% by mass of at least La and/or Ce in the form of $La_2O_3$ and/or $Ce_2O_3$.

(9) A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions are spherical or spindle-like oxide inclusions containing not less than 20% by mass of La and/or Ce in the form of $La_2O_3$ and/or $Ce_2O_3$.

(10) A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$.

(11) A low carbon steel slab characterized in that not less than 60% by mass of oxide inclusions present in the surface layer of the slab from the surface to the depth of 20 mm contain at least La and/or Ce.

(12) A low carbon steel slab characterized in that not less than 60% by mass of oxide inclusions present in the surface layer of the slab from the surface to the depth of 20 mm are spherical or spindle-like oxide inclusions containing at least La and/or Ce.

(13) A low carbon steel slab characterized in that not less than 60% by mass of oxide inclusions present in the surface layer of the slab from the surface to the depth of 20 mm are oxide inclusions containing not less than 20% by mass of at least La and/or Ce in the form of $La_2O_3$ and/or $Ce_2O_3$.

(14) A low carbon steel slab characterized in that not less than 60% by mass of oxide inclusions present in the surface layer of the slab from the surface to the depth of 20 mm are spherical or spindle-like oxide inclusions containing not less than 20% by mass of at least La and/or Ce in the form of $La_2O_3$ and/or $Ce_2O_3$.

(15) A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions contain at least La and/or Ce.

(16) A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions are spherical or spindle-like oxide inclusions containing at least La and/or Ce.

(17) A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions are oxide inclusions containing not less than 20% by mass of at least La and/or Ce in the form of $La_2O_3$ and/or $Ce_2O_3$.

(18) A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions are spherical or spindle-like oxide inclusions containing not less than 20% by mass of at least La and/or Ce in the form of $La_2O_3$ and/or $Ce_2O_3$.

(19) A process for producing a low carbon steel slab comprising the steps of: decarburizing a molten steel so as to produce a carbon concentration of up to 0.01% by mass; adding at least La and/or Ce thereto so as to produce an adjusted dissolved oxygen concentration from 0.001 to 0.02% by mass; and casting the molten steel.

(20) A process for producing a low carbon steel slab comprising the steps of: decarburizing a molten steel so as to produce a carbon concentration of up to 0.01% by mass; adding thereto Ti and at least La and/or Ce; and casting the molten steel.

(21) A process for producing a low carbon steel slab comprising the steps of: decarburizing a molten steel so as to produce a carbon concentration of up to 0.01% by mass; pre-deoxidizing the molten steel by adding Al thereto so as to produce a dissolved oxygen concentration from 0.01 to 0.04% by mass; adding thereto Ti and at least La and/or Ce; and casting the molten steel.

(22) A process for producing a low carbon steel slab comprising the steps of: decarburizing a molten steel so as to produce a carbon concentration of up to 0.01% by mass; pre-deoxidizing the molten steel by adding Al thereto and stirring the molten steel for at least 3 minutes so as to produce a dissolved oxygen concentration from 0.01 to 0.04% by mass; adding thereto Ti in an amount from 0.003 to 0.4% by mass and at least La and/or Ce in an amount from 0.001 to 0.03% by mass; and casting the molten steel.

(23) A process for producing a low carbon steel slab comprising the steps of: decarburizing a molten steel with a vacuum degassing apparatus so as to produce a carbon concentration of up to 0.01% by mass; adding at least La and/or Ce thereto so as to produce an adjusted dissolved oxygen concentration from 0.001 to 0.02% by mass; and casting the molten steel.

(24) A process for producing a low carbon steel slab comprising the steps of: decarburizing a molten steel with a vacuum degassing apparatus so as to produce a carbon concentration of up to 0.01% by mass; adding thereto Ti and at least La and/or Ce; and casting the molten steel.

(25) A process for producing a low carbon steel slab comprising the steps of: decarburizing a molten steel with a vacuum degassing apparatus so as to produce a carbon concentration of up to 0.01% by mass; pre-deoxidizing the molten steel by adding Al thereto so as to produce to a dissolved oxygen concentration from 0.01 to 0.04% by mass; adding thereto Ti and at least La and/or Ce; and casting the molten steel.

(26) A process for producing a low carbon steel slab comprising the steps of: decarburizing a molten steel with a vacuum degassing apparatus so as to produce a carbon concentration of up to 0.01% by mass; pre-deoxidizing the molten steel by adding Al thereto and stirring the molten steel for at least 3 minutes so as to produce a dissolved oxygen concentration from 0.01 to 0.04% by mass; adding thereto Ti in an amount from 0.003 to 0.4% by mass and at least La and/or Ce in an amount from 0.001 to 0.03% by mass; and casting the molten steel.

(27) The process for producing a low carbon steel slab according to any one of (19) to (26) wherein, during casting the molten steel, the molten steel is cast in a mold having an electromagnetic stirring function.

(28) The process for producing a low carbon steel slab according to any one of (19) to (26) wherein, during casting the molten steel, the molten steel is cast using mold flux having a viscosity of not lower than 4 poise at 1,300° C.

(29) The process for producing a low carbon steel slab according to any one of (19) to (26) wherein, during casting the molten steel, the molten steel is cast in a mold having an electromagnetic stirring function using mold flux having a viscosity of not lower than 4 poise at 1,300° C.

(30) The process for producing a low carbon steel slab according to any one of (19) to (26) wherein, during casting the molten steel, the molten steel is continuously cast.

(31) The process for producing a low carbon steel slab according to any one of (19) to (26) wherein, during casting a molten steel, the molten steel is continuously cast in a mold having an electromagnetic stirring function.

(32) The process for producing a low carbon steel slab according to any one of (19) to (26) wherein, during casting the molten steel, the molten steel is continuously cast using mold flux having a viscosity of not lower than 4 poise at 1,300° C.

(33) The process for producing a low carbon steel slab according to any one of (19) to (26) wherein, during casting the molten steel, the molten steel is continuously cast in a mold having an electromagnetic stirring function using mold flux having a viscosity of not lower than 4 poise at 1,300° C.

BEST MODE FOR CARRYING OUT THE INVENTION

The present invention will be explained in detail.

A molten steel decarburized with a converter and a vacuum treatment vessel contains a large amount of dissolved oxygen. Because most of the dissolved oxygen is usually decreased by deoxidation with added Al (reaction according to the formula (1)), a large amount of $Al_2O_3$ inclusions is formed.

$$2Al+3O=Al_2O_3 \quad (1)$$

These inclusions aggregate together immediately after deoxidation to form coarse alumina clusters each having a size of several hundreds of micrometers to cause surface defects during the production of a steel sheet.

For the purpose of forming no alumina clusters, the present inventors have therefore paid attention to removing the dissolved oxygen by deoxidizing the molten steel subsequent to decarburization with a deoxidizing agent other than Al.

The present inventors have devised, as a process of the invention, a process comprising the steps of: decarburizing a molten steel so as to produce a carbon concentration of up to 0.01% by mass by refining the molten steel with a steel making furnace such as a converter or an electric furnace, and further subjecting the molten steel to vacuum degassing procedure or the like; adding at least La and/or Ce thereto so as to produce an adjusted dissolved oxygen concentration from 0.001 to 0.02% by mass; and casting the molten steel. The phrase "adding at least La and/or Ce" described herein signifies adding La, adding Ce, or adding both La and Ce. The phrase is used below with the same meaning. The fundamental idea of this process is allowing dissolved oxygen to remain to such a degree that a reaction of C with oxygen to form a CO gas does not take place during casting, and adjusting the surface energy between the molten steel and inclusions by the action of the dissolved oxygen so as to inhibit aggregation of inclusions and disperse fine $La_2O_3$ inclusions, $Ce_2O_3$ inclusions or $La_2O_3$—$Ce_2O_3$ composite inclusions. When at least La and/or Ce is added to allow dissolved oxygen to remain, inclusions in an amount corresponding to the amount of the remaining dissolved oxygen are not formed. Furthermore, the present inventors have experimentally evaluated the aggregation behavior of inclusions in a molten steel by varying a dissolved oxygen concentration after adding at least La and/or Ce to the molten steel. As a result, they have made the following discoveries: even when dissolved oxygen is substantially removed by deoxidation with at least La and/or Ce, $La_2O_3$ inclusions, $Ce_2O_3$ inclusions or $La_2O_3$—$Ce_2O_3$ composite inclusions hardly aggregate in comparison with alumina type inclusions; moreover, when the dissolved oxygen concentration is set at 0.001% by mass or more, $La_2O_3$ inclusions, $Ce_2O_3$ inclusions or $La_2O_3$—$Ce_2O_3$ composite inclusions are further refined with an increase in the dissolved oxygen concentration. The above phenomena take place for the following reasons. Both the effect of varying the composition from alumina type inclusions to $La_2O_3$ inclusions, $Ce_2O_3$ inclusions or $La_2O_3$—$Ce_2O_3$ composite inclusions and the effect of increasing a dissolved oxygen concentration in the molten steel significantly lower a surface energy between the inclusions and the molten steel to inhibit aggregation of inclusions.

When a molten steel containing a large amount of dissolved oxygen is cast after decarburization without deoxidation, CO bubbles are generated during solidification to markedly lower the castability. Therefore, a deoxidizing agent such as Al has conventionally been added to a molten steel subsequent to decarburization to deoxidize the molten steel to such a degree that no dissolved oxygen substantially remains. However, because a steel sheet required to have workability has a low carbon concentration, a CO bubble formation reaction of the formula (2)

$$C+O=CO \quad (2)$$

hardly takes place during casting even when dissolved oxygen remains in the molten steel to some extent. The limit dissolved oxygen concentration at which no CO bubbles are generated is about 0.006% by mass at a C concentration of 0.04% by mass and about 0.01% by mass at a C concentration of 0.01% by mass. Moreover, for an extra low carbon steel having a still lower C concentration, no CO bubbles are generated even when dissolved oxygen is allowed to remain at a concentration of about 0.015% by mass. A continuous casting machine has recently been equipped with an electromagnetic stirring apparatus within the mold, and CO bubbles are not trapped by the slab at a dissolved oxygen concentration as high as, for example, 0.02% by mass when the molten steel is stirred during solidification. Accordingly, a molten steel for steel sheets having a C concentration of up to 0.01% by mass can be cast while dissolved oxygen is allowed to remain at a concentration of about 0.02% by mass. Conversely, when the dissolved oxygen concentration exceeds 0.02% by mass, even a molten steel for steel sheets generates CO bubbles.

Furthermore, when the dissolved oxygen concentration is lowered, the surface energy between a molten steel and inclusions cannot be lowered greatly. As a result, even $La_2O_3$ inclusions, $Ce_2O_3$ inclusions or $La_2O_3$—$Ce_2O_3$ composite inclusions gradually aggregate, and the inclusions are partly coarsened. Experimental examination concludes that at least 0.001% by mass of dissolved oxygen is required to prevent the inclusions from coarsening.

Accordingly, the dissolved oxygen concentration of a molten steel, which the carbon concentration of which has been set at 0.01% by mass or less, is restricted to from 0.001 to 0.02% by mass during adding at least Ce and/or La. That is, although addition of at least Ce and/or La is effective in refining inclusions, addition of at least Ce and/or La in a large amount markedly lowers the dissolved oxygen concentration because the elements are very strong deoxidizing agents, and the inclusion refining effect of the invention is impaired. At least La and/or Ce must therefore be added in such a range that the dissolved oxygen remains at a concentration from 0.001 to 0.02% by mass.

Next, the present inventors have devised, as another aspect of the invention, a process comprising the steps of: decarburizing a molten steel so as to produce a carbon concentration of up to 0.01% by mass, by refining the molten steel with a steel making furnace such as a converter or an electric furnace, or further subjecting the molten steel to vacuum degassing procedure or the like; adding Ti and at least La and/or Ce thereto; and casting the molten steel.

The present inventors have used Al or Ti, and at least La and/or Ce in suitable combinations as deoxidizing agents to be added to molten steels, and experimentally evaluated the aggregation behavior of these inclusions. As a result, they have made the following discovery: $Al_2O_3$ inclusions, $TiO_n$ inclusions, $Al_2O_3$—$La_2O_3$—$Ce_2O_3$ composite inclusions, $Al_2O_3$— $La_2O_3$ composite inclusions or $Al_2O_3$—$Ce_2O_3$ composite inclusions relatively easily aggregate; in contrast to the above inclusions, $TiO_n$—$La_2O_3$—$Ce_2O_3$ composite inclusions, $TiO_n$—$La_2O_3$ composite inclusions or $TiO_n$—$Ce_2O_3$ composite inclusions hardly aggregate, and are finely dispersed in molten steels. The above phenomena take place for the following reasons: the surface energy between a molten steel and any of the inclusions of $TiO_n$—$La_2O_3$—$Ce_2O_3$, $TiO_n$—$La_2O_3$ and $TiO_n$—$Ce_2O_3$ is greatly lower in comparison with the surface energy between a molten steel and any of the inclusions of $Al_2O_3$, $TiO_n$, $Al_2O_3$—$La_2O_3$—$Ce_2O_3$, $Al_2O_3$—$La_2O_3$ and $Al_2O_3$—$Ce_2O_3$, and aggregation of the inclusions is inhibited. On the basis of these discoveries, dissolved oxygen in a molten steel is decreased by deoxidation with Ti, and at least La and/or Ce is further added thereto to modify $TiO_n$ inclusions into $TiO_n$—$La_2O_3$—$Ce_2O_3$ composite inclusions, $TiO_n$—$La_2O_3$ composite inclusions or $TiO_n$—$Ce_2O_3$ composite inclusions.

As described above, inclusions in a molten steel can be finely dispersed by modifying oxide inclusions therein. The dissolved oxygen concentration in a molten steel subsequent to addition of Ti, and at least La and/or Ce therefore is not specifically defined. However, Ti, Ce and La are all deoxidizing agents, and addition of them to a molten steel in a large amount greatly lowers a dissolved oxygen concentration. Accordingly, adding Ti, Ce and La so as to produce a dissolved oxygen concentration in the range from 0.001 to 0.02% by mass is preferred because the effects of lowering the surface energy of the molten steel and avoiding aggregation of inclusions can be achieved.

Furthermore, the present inventors have devised, as another aspect of the invention, a process comprising the steps of: decarburizing a molten steel so as to produce a carbon concentration of up to 0.01% by mass by refining the molten steel with a steel making furnace such as a converter or an electric furnace, or further subjecting the molten steel to vacuum degassing or the like procedure; pre-deoxidizing the molten steel by adding Al thereto so as to produce a dissolved oxygen concentration from 0.01 to 0.04% by mass; adding Ti and at least La and/or Ce thereto; and casting the molten steel.

A more practical process is considered in view of the production cost. Entire deoxidation with Al of a molten steel subsequent to decarburization is not conducted, but the molten steel is pre-deoxidized with Al so as to allow dissolved oxygen to remain; the resultant $Al_2O_3$ inclusions are allowed to float and are removed in a short period of time to such an extent that the inclusions do not exert adverse effects, and the molten steel is deoxidized again with an element other than Al. The process makes the improvement of the quality of a steel product and the reduction of the production cost compatible.

As explained above, the present inventors have used Al or Ti, and at least La and/or Ce in suitable combinations as deoxidizing agents to be added to molten steels, and experimentally evaluated the aggregation behavior of these inclusions. They have elucidated the following results: $Al_2O_3$ inclusions, $TiO_n$ inclusions, $Al_2O_3$—$La_2O_3$—$Ce_2O_3$ composite inclusions, $Al_2O_3$—$La_2O_3$ composite inclusions or $Al_2O_3$—$Ce_2O_3$ composite inclusions relatively easily aggregate; in contrast to the above inclusions, $TiO_n$—$La_2O_3$—$Ce_2O_3$ composite inclusions, $TiO_n$—$La_2O_3$ composite inclusions or $TiO_n$—$Ce_{203}$ composite inclusions hardly aggregate and are finely dispersed in molten steels. The present inventors based on the above discoveries have been capable of forming $TiO_n$—$La_2O_3$—$Ce_2O_3$ composite inclusions, $TiO_n$—$La_2O_3$ composite inclusions or $TiO_n$—$Ce_2O_3$ composite inclusions containing no $Al_2O_3$ inclusions, and finely dispersing the inclusions in molten steels by the following procedure: in place of deoxidizing a molten steel subsequent to decarburization with Ti alone, the molten steel is at first pre-deoxidized with Al so that part of the dissolved oxygen is removed, and $Al_2O_3$ inclusions are allowed to float and are removed in a short period of time by stirring and the like procedure to such an extent that the remaining $Al_2O_3$ inclusions exert no adverse effects; the molten steel is deoxidized again with Ti so that the remaining dissolved oxygen is reduced; and at least La and/or Ce is further added. Surface defects on a steel sheet can thus be surely prevented by preventing formation of aggregates of inclusions in the molten steel and finely dispersing the inclusions in the steel sheet. The concentration of the above remaining $Al_2O_3$ inclusion subsequent to Al pre-deoxidation that exert no adverse effects is not specifically defined as long as surface defects on the steel sheet is prevented. However, usually, the inclusion concentration is as high as, for example, about 50 ppm or less.

Because La and Ce have very high deoxidation capabilities in comparison with Ti, $TiO_n$ inclusions formed after adding Ti can be easily modified into $TiO_n$—$La_2O_3$—$Ce_2O_3$ composite inclusions, $TiO_n$—$La_2O_3$ composite inclusions or $TiO_n$—$Ce_2O_3$ composite inclusions by reducing the $TiO_n$ inclusions with a small amount of Ce and/or La. However, when the dissolved oxygen concentration subsequent to Al pre-deoxidation exceeds 0.04% by mass, a large amount of $TiO_n$ inclusions is formed after adding Ti. As a result, unmodified $TiO_n$ inclusions partly remain even when La and/or Ce is added, and tend to become coarse titania clusters. On the other hand, when an addition amount of Al is increased to decrease a dissolved oxygen concentration subsequent to pre-deoxidation, a large amount of $Al_2O_3$ inclusions is formed. Accordingly, in order to decrease $Al_2O_3$ inclusions that are likely to coarsen, as much as possible, it is preferred to set a dissolved oxygen concentration subsequent to deoxidation with Al at 0.01% by mass or more. Therefore, in the present invention, the dissolved oxygen concentration subsequent to pre-deoxidation with Al is preferably adjusted to a range from 0.01% to 0.04% by mass.

Furthermore, Ti, Ce and La are all deoxidizing agents, and addition of them to a molten steel in a large amount greatly decreases a dissolved oxygen concentration. Adding Ti, Ce and La to produce a dissolved oxygen concentration from 0.001 to 0.02% by mass is preferred because the effects of lowering the surface energy of the molten steel and avoiding aggregation of inclusions can be achieved.

Furthermore, it is desirable to allow Al not to remain in the molten steel for the purpose of forming no alumina type inclusions that are likely to aggregate. However, Al may be allowed to remain when the amount is small. In this case, the dissolved oxygen must be allowed to remain in a molten steel in an amount of at least 0.001% by mass. According to thermodynamic calculation, the dissolved Al concentration at 1,600° C. should be up to 0.005% by mass.

Still furthermore, the present inventors have devised, as a detailed aspect of the invention, a process comprising the steps of: decarburizing a molten steel so as to produce a carbon concentration of up to 0.01% by mass by refining the molten steel with a steel making furnace such as a converter or an electric furnace, or further subjecting the molten steel to vacuum degassing procedure or the like; pre-deoxidizing the molten steel by adding Al thereto and stirring the molten steel for at least 3 minutes so as to produce a dissolved oxygen concentration from 0.01 to 0.04% by mass; adding thereto Ti in an amount from 0.003 to 0.4% by mass and at least La and/or Ce in an amount from 0.001 to 0.03% by mass; and casting the molten steel.

Experimental examination has clarified that most of $Al_2O_3$ inclusions can be allowed to float and be removed by setting a dissolved oxygen concentration subsequent to Al addition during the pre-deoxidation at 0.01% by mass or more, and ensuring a stirring time of at least 3 minutes after Al addition. In particular, when a vacuum degassing apparatus is employed, the molten steel is commonly circulated as a stirring procedure after Al addition.

When the molten steel subsequent to pre-deoxidation is deoxidized by adding a small amount of Ti, part of the dissolved oxygen remains in the molten steel due to a weak deoxidation capability of Ti compared with Al. As explained above, when the dissolved oxygen concentration exceeds 0.02% by mass in a molten steel for steel sheets having a C concentration of up to 0.01% by mass, CO bubbles are generated. Ti must therefore be added to the molten steel so as to produce a dissolved oxygen concentration of up to 0.02% by mass. The equilibrium calculation indicates that the Ti concentration is at least 0.003% by mass. On the other hand, although Ti is a deoxidizing agent having a relatively weak deoxidation capability, addition of Ti to the molten steel in a large amount greatly lowers a dissolved oxygen concentration of the molten steel. As a result, even subsequent addition of at least La and/or Ce hardly modifies the inclusions in the molten steel into composite inclusions of $TiO_n$—$La_2O_3$—$Ce_2O_3$, $TiO_n$—$La_2O_3$ or $TiO_n$—$Ce_2O_3$. Therefore, the effect of refining inclusions of the invention is impaired. The Ti concentration must therefore be set at 0.4% by mass or less to allow dissolved oxygen to remain at a concentration of about several ppm. It can be concluded from the above explanation that the Ti concentration desirably is set at from 0.003% by mass or more to 0.4% by mass.

Addition of at least La and/or Ce is effective in refining inclusions. However, because La and Ce are strong deoxidizing agents, they react with refractories and mold flux to contaminate the molten steel and deteriorate the refractories and mold flux. Therefore, the addition amount of at least La and/or Ce is at least an amount necessary for modifying the $TiO_n$ inclusions thus formed, and up to an amount not to contaminate the molten steel by the reaction of La and Ce with refractories and mold flux. It is concluded from the experimental examination that the proper range of the concentration of at least La and/or Ce in the molten steel is from at least 0.001% by mass to 0.03% by mass. Moreover, La and/or Ce are not always added within a vacuum degassing apparatus, and may be added to the molten steel after Ti is added and before the molten steel is allowed to flow into a mold. For example, they may be added within a tundish. Moreover, La and/or Ce may be added using pure La and/or Ce. They may also be added in the form of an alloy containing La and/or Ce such as misch metal. Even when other impurities are mixed into the molten steel in combination with La and/or Ce, the effect of the present invention is not impaired as long as a total concentration of La and/or Ce in the alloy is at least 30% by mass.

Moreover, in the above process, the molten steel may be decarburized with a vacuum degassing apparatus.

Furthermore, Ti, Ce and La are all deoxidizing agents, and addition of them to a molten steel in a large amount greatly decreases a dissolved oxygen concentration. Adding Ti, Ce and La to produce a dissolved oxygen concentration from 0.001 to 0.02% by mass is preferred because the effects of lowering the surface energy of the molten steel and avoiding aggregation of inclusions can be achieved.

When a molten steel of the present invention is continuously cast, $La_2O_3$ inclusions, $Ce_2O_3$ inclusions, $La_2O_3$—$Ce_2O_3$ composite inclusions, $TiO_n$—$La_2O_3$ composite inclusions, $TiO_n$—$Ce_2O_3$ composite inclusions and $TiO_n$—$La_2O_3$—$Ce_2O_3$ composite inclusions are absorbed in mold flux as the casting time passes, and there is a possibility of a lowering of the mold flux viscosity. The lowering of the mold flux viscosity promotes inclusion of the flux, and the inclusion causes of mold flux-caused defects. When a molten steel of the invention is to be continuously cast, it is therefore effective to design a higher mold flux viscosity in advance while viscosity lowering caused by absorption of the inclusions is taken into consideration. Experimental results show that defects caused by mold flux have not been formed when the viscosity of the mold flux at 1300° C. is set at 4 poise or more.

Furthermore, the mold flux has a function of lubricating a movement between the mold and the slab, and the upper limit of the viscosity is not particularly defined as long as the function is not impaired.

The present invention can be applied to both ingot casting and continuous casting. For continuous casting, the present invention is applied not only to continuous casting of an ordinary slab having a thickness of about 250 mm but also to continuous casting of a thin slab with a continuous casting machine having a smaller mold thickness of, for example, 150 mm or less to manifest sufficient effects and give a slab having extremely decreased surface defects.

Furthermore, steel sheets can be produced from the slabs obtained by the above process by conventional procedures such as hot rolling and cold rolling.

Evaluation of the dispersed state of inclusions in the surface layer from the surface to the depth of 20 mm of a slab obtained by the process of the present invention has given the following results: fine oxide inclusions having a diameter from 0.5 to 30 μm are dispersed therein with the number being from not less than 1,000 to 100,000 pieces/$cm^2$. When inclusions are dispersed as fine oxide inclusions as explained above, prevention of surface defects can be achieved. The dispersed state of inclusions herein has been evaluated from an inclusion particle size distribution in a unit area by optical-microscopically observing the ground surface of a slab or steel sheet at magnifications of 100 and 1,000. The particle size, namely, the diameter of an inclusion is obtained by measuring the major and minor axes, and calculating from the formula $$\text{particle size (diameter)}=(\text{major axis}\times\text{minor axis})^{0.5}$$

The major and minor axes used herein are the same as those usually used for an ellipse or the like.

Furthermore, when not less than 60% by mass of oxide inclusions present in the surface layer of the slab from the surface to the depth of 20 mm contain at least La and/or Ce, aggregation of inclusions is inhibited as explained above, and the effect of finely dispersing inclusions is achieved.

Moreover, the oxide inclusions are usually spherical or spindle-like oxide inclusions.

Furthermore, when not less than 60% by mass of oxide inclusions present in the surface layer of a slab from the surface to the depth of 20 mm are oxide inclusions containing not less than 20% by mass, preferably not less than 40% by mass, more preferably not less than 55% by mass of at least La and/or Ce in the form of $La_2O_3$ and/or $Ce_2O_3$, the effect of refining inclusions as explained above is produced.

Furthermore, the oxide inclusions are usually spherical or spindle-like oxide inclusions.

In addition, the present inventors have paid attention to the distribution of inclusions in the surface layer from the surface to the depth of 20 mm because it is highly possible that the inclusions in the above range be exposed to the surface after rolling to form surface defects.

Furthermore, a steel sheet obtained by working a slab having the oxide inclusions that have such a dispersed state, a composition and a shape as explained above, for example, a hot rolled steel sheet obtained by hot rolling, a cold rolled steel sheet obtained by further cold rolling the hot rolled steel sheet, and the like sheet are each defined as a steel sheet in the present invention.

It has been concluded from the evaluation of the dispersed state of inclusions in a steel sheet that the dispersed state is substantially the same as that of oxide inclusions in the surface layer of a slab from the surface to the depth of 20 mm.

A steel sheet obtained by working a slab having such a dispersed state, a composition and a shape of oxide inclusions as explained above has not formed surface defects. It is concluded from the above results that because inclusions can be finely dispersed in a molten steel by the present invention, the inclusions cause no formation of surface defects during the production of a steel sheet, and the quality of a steel sheet is greatly improved.

EXAMPLES

The present invention will be explained by making reference to examples and comparative examples.

Example 1

A molten steel in an amount of 300 tons in a ladle, having been refined in a converter and treated in a circulation type vacuum degassing apparatus to have a carbon concentration of 0.003% by mass, was deoxidized with Ce to have a Ce concentration of 0.0002% by mass and a dissolved oxygen concentration of 0.0014% by mass. The molten steel was continuously cast into slab steel having a thickness of 250 mm and a width of 1,800 mm. The cast slab steel was cut to give slabs each having a length of 8,500 mm (each slab being one coil unit). Each slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the slab quality was evaluated from the number of surface defects formed per coil. As a result, no surface defects were found.

Example 2

A molten steel in an amount of 300 tons in a ladle, having been refined in a converter and treated in a circulation type vacuum degassing apparatus to have a carbon concentration of 0.003% by mass, was deoxidized with Ti and Ce to have a Ti concentration of 0.008% by mass, a Ce concentration of 0.0001% by mass and a dissolved oxygen concentration of 0.0022% by mass. The molten steel was continuously cast into slab steel having a thickness of 250 mm and a width of 1,800 mm. The cast slab steel was cut to give slabs each having a length of 8,500 mm (each slab being one coil unit). Each slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the slab quality was evaluated from the number of surface defects formed per coil. As a result, no surface defects were found.

Example 3

Al for pre-deoxidation in an amount of 100 kg was added to 300 tons of a molten steel in a ladle having been refined with a converter and treated with a vacuum degassing apparatus to have a carbon concentration of 0.003% by mass, and the molten steel was circulated for 3 minutes to have a dissolved oxygen concentration of 0.02% by mass. Ti in an amount of 200 kg was further added to the molten steel, and the molten steel was circulated for 1 minute. Thereafter, the additives Ce, La and 40 mass % La-60 mass % Ce each in an amount of 40 kg were added to three separate molten steels each in a ladle, respectively. As a result, one of the molten steels had a Ti concentration of 0.03% by mass and a Ce concentration of 0.007% by mass. Another molten steel had a Ti concentration of 0.03% by mass and a La concentration of 0.007% by mass. The other molten steel had a Ti concentration of 0.03% by mass and a La concentration and a Ce concentration in total of 0.007% by mass. Each molten steel was continuously cast into slab steel having a thickness of 250 mm and a width of 1,800 mm. Mold flux used during casting had a viscosity of 6 poise. The cast slab steel was cut to give slabs each having a length of 8,500 mm (each slab being one coil unit). Inclusions in the surface layer from the surface to the depth of 20 mm of the slab were examined. Each slab prepared by addition of Ce alone or La alone, or by composite addition of La—Ce had fine oxide inclusions from 0.5 to 30 μm in diameter dispersed therein with the number being from 11,000 to 13,000 pieces/$cm^2$. Seventy-five percent by mass of the fine oxide inclusions were spherical or spindle-like oxide inclusions containing not less than 57% by mass of $La_2O_3$ alone, $Ce_2O_3$ alone, or $La_2O_3$ and $Ce_2O_3$ in total. Each slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the steel sheet quality was evaluated from the number of surface defects formed per coil. As a result, no surface defects were formed in any of the coils each prepared by addition of Ce alone or La alone, or by composite addition of La—Ce. Moreover, when inclusions in any of the cold rolled steel sheets each prepared by addition of Ce alone or La alone, or by composite addition of La—Ce were examined, the steel sheet had fine oxide inclusions from 0.5 to 30 μm in diameter dispersed therein with the number being from 11,000 to 13,000 pieces/$cm^2$. Seventy-five percent by mass of the fine oxide inclusions were spherical or spindle-like oxide inclusions containing not less than 57% by mass of $La_2O_3$ alone, $Ce_2O_3$ alone, or $La_2O_3$ and $Ce_2O_3$ in total.

Example 4

Al for pre-deoxidation in an amount of 150 kg was added to 300 tons of a molten steel in a ladle having been refined with a converter and treated with a vacuum degassing apparatus to have a carbon concentration of 0.005% by mass, and the molten steel was circulated for 5 minutes to have a dissolved oxygen concentration of 0.012% by mass.

Ti in an amount of 250 kg was further added to the molten steel, and the molten steel was circulated for 2 minutes. Thereafter, the additives Ce, La and 40 mass % La-60 mass % Ce each in an amount of 100 kg were added to three separate molten steels each in a ladle, respectively. As a result, one of the molten steels had a Ti concentration of 0.045% by mass and a Ce concentration of 0.018% by mass. Another molten steel had a Ti concentration of 0.045% by mass and a La concentration of 0.018% by mass. The other molten steel had a Ti concentration of 0.045% by mass and a La concentration and a Ce concentration in total of 0.018% by mass. Each molten steel was continuously cast into thin slab steel having a thickness of 70 mm and a width of 1,800 mm. Mold flux used during casting had a viscosity of 5 poise. The cast slab steel was cut to give slabs each having a length of 10,000 mm (each slab being one coil unit). Inclusions in the surface layer from the surface to the depth of 20 mm of the slab were examined. Each slab prepared by addition of Ce alone or La alone, or by composite addition of La—Ce had fine oxide inclusions from 0.5 to 30 μm in diameter dispersed therein with the number being from 12,000 to 14,000 pieces/cm$^2$. Eighty percent by mass of the fine oxide inclusions were spherical or spindle-like oxide inclusions containing not less than 60% by mass of $La_2O_3$ alone, $Ce_2O_3$ alone, or $La_2O_3$ and $Ce_2O_3$ in total. Each thin slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the steel sheet quality was evaluated from the number of surface defects occurred per coil. As a result, no surface defects were occurred in any of the coils each prepared by addition of Ce alone or La alone, or by composite addition of La—Ce. Moreover, when inclusions in any of the cold rolled steel sheets each prepared by addition of Ce alone or La alone, or by composite addition of La—Ce were examined, the steel sheet had fine oxide inclusions from 0.5 to 30 μm in diameter dispersed therein with the number being from 12,000 to 14,000 pieces/cm$^2$. Eighty percent by mass of the fine oxide inclusions were spherical or spindle-like oxide inclusions containing not less than 60% by mass of $La_2O_3$ alone, $Ce_2O_3$ alone, or $La_2O_3$ and $Ce_2O_3$ in total.

Example 5

Al for pre-deoxidation in an amount of 50 kg was added to 300 tons of a molten steel in a ladle having been refined with a converter and treated with a vacuum degassing apparatus to have a carbon concentration of 0.001% by mass, and the molten steel was circulated for 3 minutes to have a dissolved oxygen concentration of 0.038% by mass. Ti in an amount of 80 kg was further added to the molten steel, and the molten steel was circulated for 2 minutes. Thereafter, the additives Ce, La and 30 mass % La-70 mass % Ce each in an amount of 30 kg were added to three separate molten steels each in a ladle, respectively. As a result, one of the molten steels had a Ti concentration of 0.01% by mass and a Ce concentration of 0.005% by mass. Another molten steel had a Ti concentration of 0.01% by mass and a La concentration of 0.005% by mass. The other molten steel had a Ti concentration of 0.01% by mass and a La concentration and a Ce concentration in total of 0.005% by mass. Each molten steel was continuously cast into slab steel having a thickness of 250 mm and a width of 1,800 mm. Mold flux used during casting had a viscosity of 8 poise. The cast slab steel was cut to give slabs each having a length of 8,500 mm (each slab being one coil unit). Inclusions in the surface layer from the surface to the depth of 20 mm of the slab were examined. Each slab prepared by addition of Ce alone or La alone, or by composite addition of La—Ce had fine oxide inclusions from 0.5 to 30 μm in diameter dispersed therein with the number being from 8,000 to 10,000 pieces/cm$^2$. Seventy-five percent by mass of the fine oxide inclusions were spherical or spindle-like oxide inclusions containing not less than 58% by mass of $La_2O_3$ alone, $Ce_2O_3$ alone, or $La_2O_3$ and $Ce_2O_3$ in total. Each slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the steel sheet quality was evaluated from the number of surface defects occurred per coil. As a result, no surface defects were occurred in any of the coils each prepared by addition of Ce alone or La alone, or by composite addition of La—Ce. Moreover, when inclusions in any of the cold rolled steel sheets each prepared by addition of Ce alone or La alone, or by composite addition of La—Ce were examined, the steel sheet had fine oxide inclusions from 0.5 to 30 μm in diameter dispersed therein with the number being from 8,000 to 10,000 pieces/cm$^2$. Seventy-five percent by mass of the fine oxide inclusions were spherical or spindle-like oxide inclusions containing not less than 58% by mass of $La_2O_3$ alone, $Ce_2O_3$ alone, or $La_2O_3$ and $Ce_2O_3$ in total.

Comparative Example 1

A molten steel in a ladle having been refined with a converter and treated with a circulation type vacuum degassing apparatus to have a carbon concentration of 0.003% by mass was deoxidized with Al to have an Al concentration of 0.04% by mass and a dissolved oxygen concentration of 0.0002% by mass. The molten steel was continuously cast into slab steel having a thickness of 250 mm and a width of 1,800 mm. The cast slab steel was cut to give slabs each having a length of 8,500 mm (each slab being one coil unit). Each slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the slab quality was evaluated from the number of surface defects occurred per coil. As a result, the average number of surface defects occurred per coil was 5 pieces/coil.

Comparative Example 2

A molten steel in a ladle having been refined with a converter and treated with a vacuum degassing apparatus to have a carbon concentration of 0.003% by mass was deoxidized with Al to have an Al concentration of 0.04% by mass and a dissolved oxygen concentration of 0.0002% by mass. The molten steel was continuously cast into slab steel having a thickness of 250 mm and a width of 1,800 mm. The cast slab steel was cut to give slabs each having a length of 8,500 mm (each slab being one coil unit). Inclusions in the surface layer from the surface to the depth of 20 mm of the slab were examined. As a result, fine oxide inclusions having a diameter from 0.5 to 30 μm were present in the slab with the number being only 500 pieces/cm$^2$. Ninety-eight percent of the oxide inclusions were alumina clusters. Each slab thus obtained was conventionally hot rolled and cold rolled to finally give a cold rolled steel sheet in a coil having a thickness of 0.7 mm and a width of 1,800 mm. The cold rolled steel sheet was visually observed on the inspection line subsequent to cold rolling, and the steel sheet quality was evaluated from the number of surface defects occurred per coil. As a result, the average number of surface defects occurred per coil was 5 pieces/coil. Moreover, when inclusions in the cold rolled steel sheet were examined, fine oxide inclusions having a diameter from 0.5 to 30 μm were present in the slab with the number being only 600 pieces/$cm^2$, and 98% by mass of them were alumina clusters.

INDUSTRIAL APPLICABILITY

As explained above, because inclusions in a molten steel can be made finely dispersed according to the present invention, a low carbon steel sheet that can be surely prevented from occurring surface defects and that is excellent in workability and formability can be produced.

The invention claimed is:

1. A low carbon steel sheet having a thickness characterized by having oxide inclusions containing Ti-oxide finely dispersed throughout the thickness, and not less than 60% by mass of oxide inclusions present throughout the thickness contain at least La and/or Ce.

2. A low carbon steel sheet having a thickness characterized by having oxide inclusions containing Ti-oxide finely dispersed throughout the thickness, and not less than 60% by mass of oxide inclusions present throughout the thickness are spherical or spindle oxide inclusions containing at least La and/or Ce and having a diameter from 0.5 to 30 μm.

3. A low carbon steel sheet having a thickness characterized by having oxide inclusions containing Ti-oxide finely dispersed throughout the thickness, and not less than 60% by mass of oxide inclusions present throughout the thickness are oxide ones containing not less than 20% by mass of at least La and/or Ce in the form of $La_2O_3$ and/or $Ce_2O_3$.

4. A low carbon steel sheet having a thickness characterized by having oxide inclusions containing Ti-oxide finely dispersed throughout the thickness, and not less than 60% by mass of oxide inclusions present throughout the thickness are spherical or spindle oxide inclusions containing not less than 20% by mass of at least La and/or Ce in the form of $La_2O_3$ and/or $Ce_2O_3$ and having a diameter from 0.5 to 30 μm.

5. A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions contain at least La and/or Ce.

6. A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions are spherical or spindle oxide inclusions containing at least La and/or Ce.

7. A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions are oxide inclusions containing not less than 20% by mass of at least La and/or Ce in the form of $La_2O_3$ and/or $Ce_2O_3$.

8. A low carbon steel sheet characterized in that fine oxide inclusions having a diameter from 0.5 to 30 μm are dispersed therein with the number being from not less than 1,000 to less than 100,000 pieces/$cm^2$, and that not less than 60% by mass of the oxide inclusions are spherical or spindle oxide inclusions containing not less than 20% by mass of La and/or Ce in the form of $La_2O_3$ and/or $Ce_2O_3$.

9. A low carbon steel slab characterized by having a substantially homogeneous steel composition throughout the slab and having oxide inclusions containing Ti-oxide and oxide inclusions containing La and/or Ce finely dispersed throughout the steel of the slab and wherein not less than 60% by mass of oxide inclusions present in the slab throughout a region of the slab from the surface to the depth of 20 mm contain at least La and/or Ce.

10. A low carbon steel slab characterized by having a substantially homogeneous steel composition throughout the slab and having oxide inclusions containing Ti-oxide and oxide inclusions containing La and/or Ce finely dispersed throughout the steel of the slab and wherein not less than 60% by mass of oxide inclusions present in the slab throughout a region of the slab from the surface to the depth of 20 mm are spherical or spindle oxide inclusions containing at least La and/or Ce.

11. A low carbon steel slab characterized by having a substantially homgeneous steel composition throughout the slab and having oxide inclusions containing Ti-oxide and oxide inclusions containing La and/or Ce finely dispersed throughout the steel of the slab and wherein not less than 60% by mass of oxide inclusions present in the slab throughout a region of the slab from the surface to the depth of 20 mm are oxide inclusions containing not less than 20% by mass of at least La and/or Ce in the form of $La_2O_3$ and/or $Ce_2O_3$.

12. A low carbon steel slab characterized by having a substantially homogeneous steel composition throughout the slab and having oxide inclusions containing Ti-oxide and oxide inclusions containing La and/or Ce finely dispersed throughout the steel of the slab and wherein not less than 60% by mass of oxide inclusions present in the slab throughout a region of the slab from the surface to the depth of 20 mm are spherical or spindle oxide inclusions containing not less than 20% by mass of at least La and/or Ce in the form of $La_2O_3$ and/or $Ce_2O_3$.

13. A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions contain at least La and/or Ce.

14. A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions are spherical or spindle oxide inclusions containing at least La and/or Ce.

15. A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions are oxide inclusions containing not less than 20% by mass of at least La and/or Ce in the form of $La_2O_3$ and/or $Ce_2O_3$.

16. A low carbon steel slab characterized in that fine oxide inclusions having a diameter from 0.5 to 30 μm are dispersed in the surface layer of the slab from the surface to the depth of 20 mm with the number being from not less than 1,000 to less than 100,000 pieces/$cm^2$, and that not less than 60% by mass of the oxide inclusions are spherical or spindle oxide inclusions containing not less than 20% by mass of at least La and/or Ce in the form of $La_2O_3$ and/or $Ce_2O_3$.

* * * * *